United States Patent [19]

Bianchi

[11] Patent Number: 4,728,378

[45] Date of Patent: Mar. 1, 1988

[54] METHOD OF GLUING, TO THE INSOLE OF A FOOTWEAR BLANK, THE SIDES OF A RESPECTIVE UPPER, AND A SIDE-LASTING MACHINE FOR IMPLEMENTING THE METHOD

[75] Inventor: Carlo Bianchi, Gambolo', Italy

[73] Assignee: Officine Meccaniche Molina & Bianchi, S.p.A., Vigevano, Italy

[21] Appl. No.: 833,910

[22] Filed: Feb. 26, 1986

[30] Foreign Application Priority Data

Feb. 26, 1985 [IT] Italy ..... 19644 A/85

[51] Int. Cl.[4] ..... B32B 31/00; A43D 21/00; A43D 25/18

[52] U.S. Cl. ..... 156/64; 12/10; 12/12; 12/145; 156/356; 156/360; 156/378

[58] Field of Search ..... 156/350, 351, 356, 358, 156/360, 367, 378; 12/8.3, 10, 10.1, 10.8, 12, 12.4, 12.5, 145, 7, 8.81, 12.41, 8.1, 8.2

[56] References Cited

U.S. PATENT DOCUMENTS

| | | | |
|---|---|---|---|
| 3,101,495 | 8/1963 | Peterson | 12/12.4 |
| 3,685,072 | 8/1972 | Schindler et al. | 12/12 |
| 4,192,033 | 3/1980 | Reedman et al. | 12/10.1 |

*Primary Examiner*—Donald E. Czaja
*Assistant Examiner*—Geoffrey L. Knable
*Attorney, Agent, or Firm*—Hedman, Gibson, Costigan & Hoare

[57] ABSTRACT

In a footwear side-lasting machine, the setting movement of pressure members is automated which are operative to upturn and press onto a margin of a footwear blank insole coated with an adhesive a flap of its respective upper, while monitoring the curvature of the footwear blank insole and driving, based on such monitoring, motive members for the setting movement of the pressure members.

5 Claims, 4 Drawing Figures

METHOD OF GLUING, TO THE INSOLE OF A FOOTWEAR BLANK, THE SIDES OF A RESPECTIVE UPPER, AND A SIDE-LASTING MACHINE FOR IMPLEMENTING THE METHOD

DESCRIPTION

This invention has for its subject matter a method of gluing, to the insole of a footwear blank, the sides of a respective upper, and a machine specially developed for implementing this method and of a type which comprises, mounted to a frame, a holder for holding a footwear blank at an operational setting, an adhesive spreading member for spreading adhesive over the insole of said blank, plural pressure members adapted to be set onsaid frame adjustably around said operational setting position and to upturn and press a flap of the upper of said blank onto a margin of said insole coated with adhesive.

Machines of the aforesaid type are referred to in the pertinent art as side-lasting machines.

According to prior techniques, such machines are employed in a footwear manufacturing cycle to spread an appropriate adhesive over and along the margin of the insole of a footwear blank, at the arch of the foot, and to upturn and press onto the area treated with adhesive (of the insole) the respective upper flaps.

The second-mentioned operation is performed by means of pressure members which act on the upper and insole somehow like mechanical fingers by holding on one side of the insole the upper at an appropriate position to upturn and press on the other side of the free flap of the aforesaid insole.

It is, therefore, necessary that such pressure members be suitably set around the operational setting of the sidelasting machine to correctly follow the insole outline.

The insole region that corresponds to the arch of the foot has, depending on the footwear conformation, radii of curvature which vary within a broad range and are sometimes quite pronounced, especially with high-heeled lady's shoes.

Thus, each time that the type of footwear being processed changes, and particularly when switching over to footwear with a different curvature of the arch of the foot, adjustment of the pressure members which must be properly set becomes necessary.

To permit that setting, the pressure members are mounted on slide holders which can be displaced by operating handwheels or the like means of positional adjustment.

The setting operation is to be performed by an operator of the side-lasting machine, who acts manually to effect appropriate adjustments whenever required.

The adjustment accuracy is closely related to the operator's skill and the care he/she exerts in making it.

Furthermore, any adjustment operation involves a shutdown of the specific machine, and attendant stop or at least decrease in the output of the entire production cycle whereto the machine is correlated.

Not least, owing to the unaccuracy of a manual adjustment procedure, it is not unfrequent for the operator to proceed by successive approximations resulting, at each change of the shape of footwear being processed, in a period of temporary "settling" of the adjustments during which inferior quality products are yielded.

The problem underlying this invention is that of automating in a simple and economical way, but a reliable one, the step of setting the pressure members on a side-lasting machine in conformity with the curvature of the insole of a piece of footwear to be produced.

That problem is solved by a method of gluing, to the insole of a footwear blank, the sides of a respective upper, which comprises the following steps:

arranging a footwear blank at an operational setting on a side-lasting machine;

surveying the curvature of said insole to issue a signal proportional to said curvature;

supplying said signal to a summing node fed with a signal proportional to the set position of pressure members provided on said machine around said operational setting position;

comparing said signals in said summing node to issue a difference signal;

driving, by means of said difference signal, motive members for setting said pressure members.

Thus, according to this method, the insole of a piece of footwear being processed is utilized as a "template" for setting the pressure members in their proper working position in accordance with the curvature of the arch of the foot.

Advantageously, the insole curvature is surveyed concurrently with the spreading of cement over and along the margins of the insole, in the area of the arch of the foot.

A machine of the aforesaid type, for implementing the method of this invention, is characterized in that it comprises, mounted to said frame, a surveyor of the curvature of said insole acting at the arch of the foot region thereof, motive members for setting said pressure members, a transducer connected to the surveyor for converting the signal received therefrom to an electric signal, a microprocessor fed with said electric signal as supplied by the transducer, and shut-off members on the power circuit to said motive members driven electrically by said microprocessor.

The features and advantages of the invention will be more clearly apparent from the following detailed description of a preferred embodiment of the machine for gluing the sides of a footwear upper to the insole, according to the invention, given herein by way of illustration and not of limitation with reference to the accompanying drawings, where:

Figure 1:
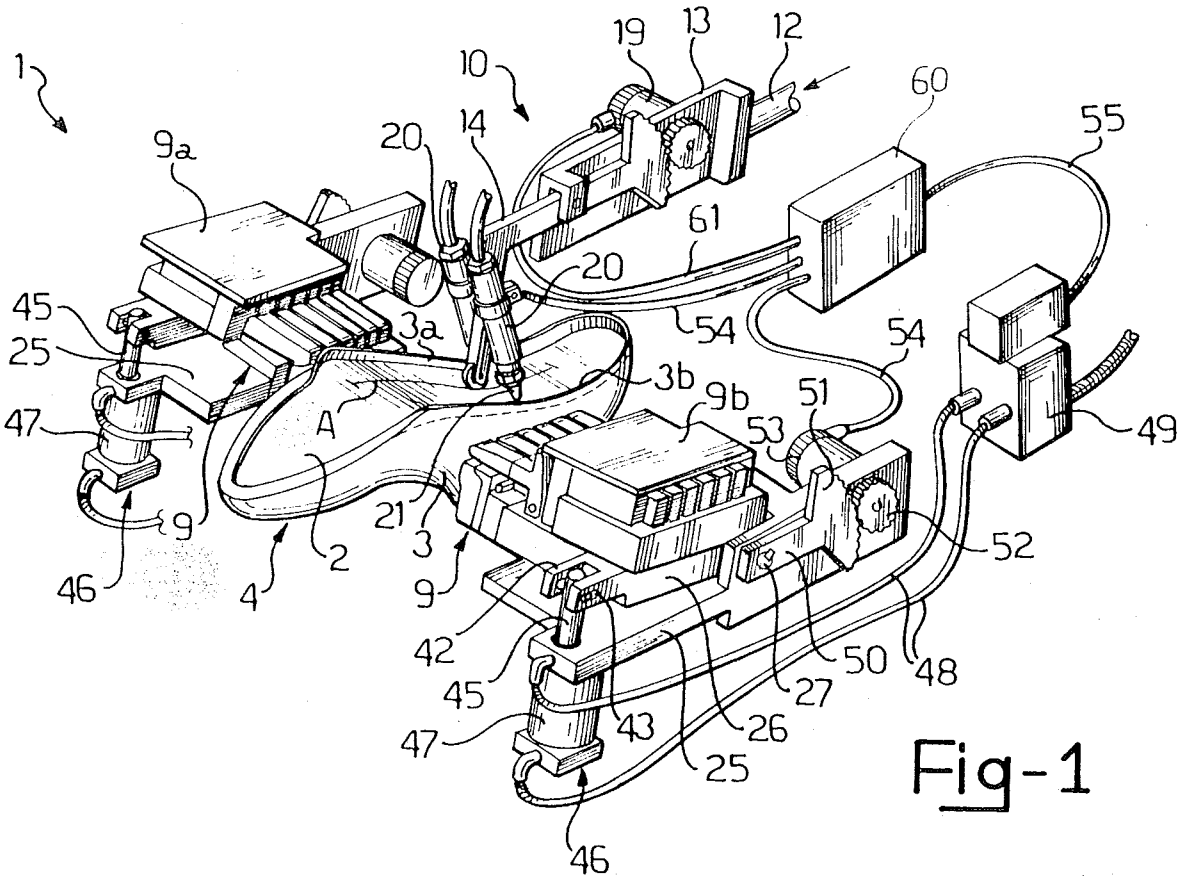
FIGS. 1 and 2 show diagramatically a perspective view and a side elevation view, respectively, of the main members of a machine according to the invention.
Figure 2:
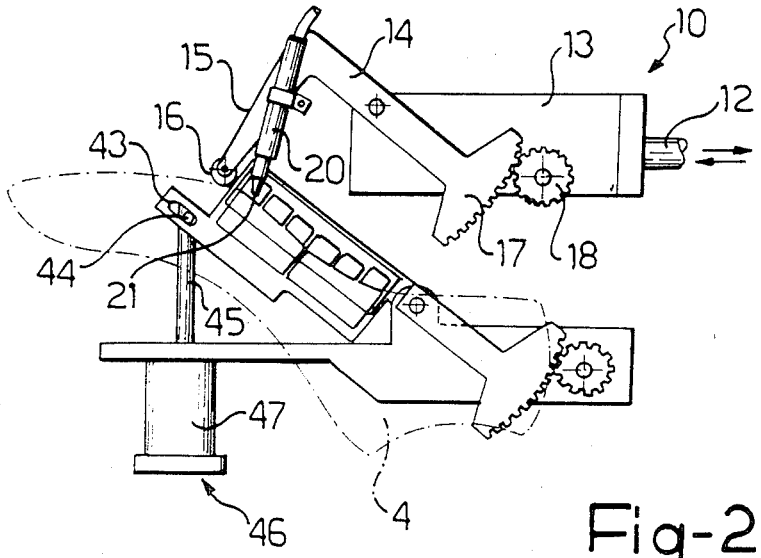
Figure 3:
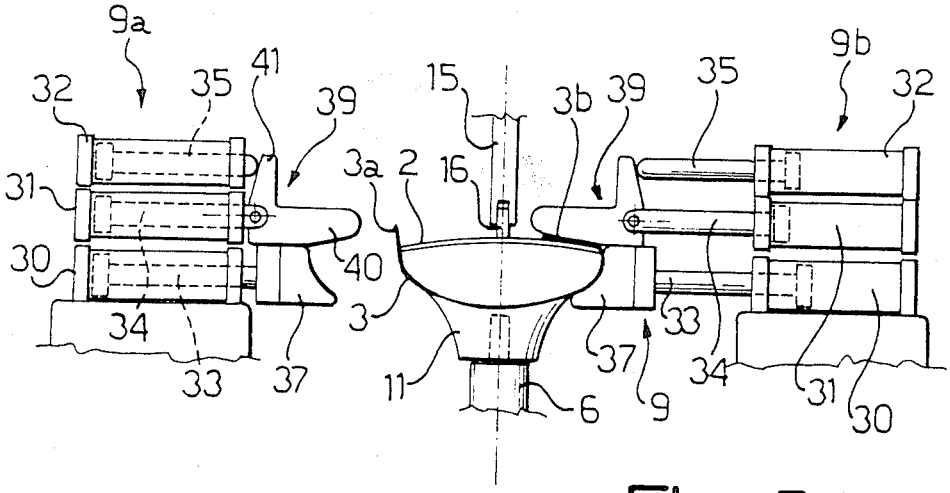
FIG. 3 is a sectional view of a detail of the pressure members in the machine of the preceding Figures.
Figure 4:
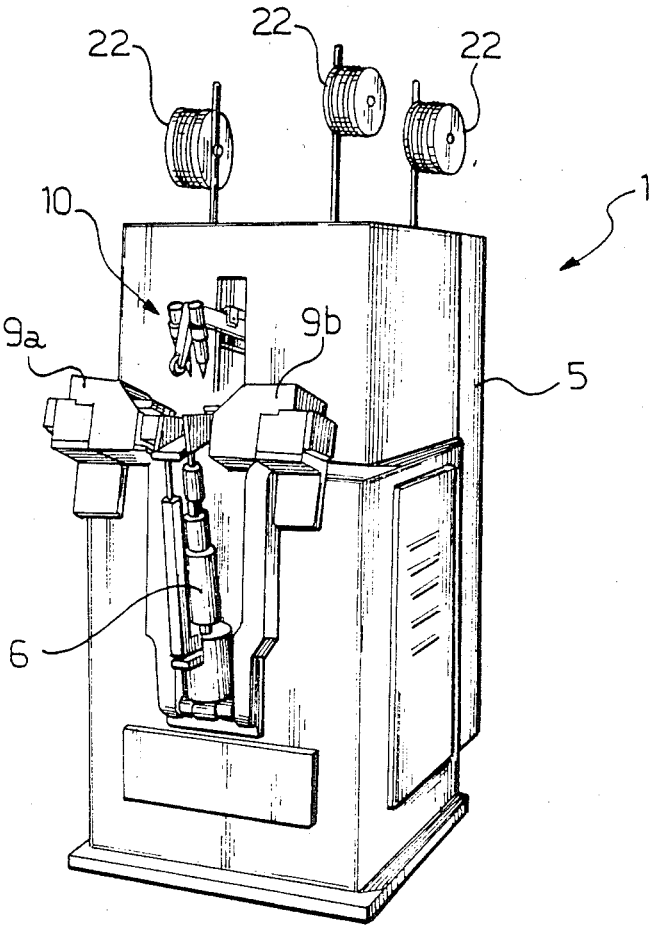
FIG. 4 shows, diagramatically and in perspective, a machine according to the invention.

In the cited drawing figures, a machine for gluing the sides 3*a* and 3*b* of the upper 3 of a footwear blank 4 to a insole 2, generally referred to in the art as "side-lasting machine", is comprehensively designated 1.

It comprises a frame 5, a substantially vertical pedestal 6 having one end journalled to the base of the frame 5 and an opposite free end, two groups 9*a* and 9*b*, respectively, of pressure members 9 facing each other and positioned on the frame 5 at the free end of the pedestal 6, and a member 10 for spreading adhesive over the insole 2 of the blank 4. The blank 4 is fitted over a former 11 carried in turn on the free end of the pedestal 6 in an operational setting defined between the groups 9*a* and 9*b* of pressure members 9.

The spreader member 10 comprises a fluid operated cylinder supported on the frame 5 and having a piston rod 12 movable in a perpendicular direction to the pedestal 6 above the free end thereof. Attached to the free end of the rod 12 is a bracket 13 carrying a rocker arm 14 pivoted thereto.

The arm 14 has a first end 15 bent toward the pedestal 6 and provided with an end wheel 16 and a second end 17 forming a gear segment with its center of curvature on the pivot axis of the arm 14.

To the end 15 of the arm 14 there are attached a pair of adhesive dispensers 20, each having a nozzle 21 pointed toward the pedestal 6.

The adhesive used is in general a bead of a heat-fusing plastics, stored in coils 22 mounted on the frame 5.

The gear segment at the end 17 of the arm 14 meshes with a pinion 18 keyed to the shaft of an angular displacement transducer 19, referred to as "encoder" in English terminology.

The transducer 19 is connected electrically to the input of a microprocessor 60 by a cable 61.

Each group *9a, 9b* of pressure members 9 comprises a bracket 25 fast with the frame 5, a base 26 hinged to the bracket 25 and oscillating over it around a pin 27, and three series of fluid-operated cylinders mounted on the base 26, with one series superimposed on the other. The fluid-operated cylinders in each series are indicated at 30,31 and 32, respectively, and all the cylinders have respective piston rods 33,34 and 35 oriented inwardly of the operational setting defined above, that is toward the free end of the pedestal 6.

Attached to the rod 33 of each cylinder in the first series is an elastic pad 37 adapted to hold the upper 3 pressed down on the former 11.

To the rod 34 of each cylinder 31 in the second series, there is attached oscillably a small crank lever 39 having a first side 40 parallel to the insole and intended to upturn the flap *3a* (*3b*) of the upper onto the insole, and a second side 41 subjected to the action of the rod 35 of the corresponding fluid-operated cylinder 32 in the third series of cylinders.

Each base 26 has, at the remote end from the pin 27, a projecting portion 42 formed with slotted holes 43.

Connected to the portion 42 by a pin 44 passed through the holes 43 is a piston rod 45 of a fluid-operated double-acting cylinder 46, with a casing 47 fast with the bracket 25 and forming a respective motive member for the setting movement of the pressure members 9.

The fluid-operated cylinder 46 has a power circuit 48 wherein a fluid shut-off solenoid valve 49 is connected.

Keyed to the pin 27 is an arm 50 rotatively rigid with the base 26 and having one end 51 configured as a gear segment.

The gear segment end 51 meshes with a pinion 52 keyed to the shaft of a respective transducer 53 adapted to sense angular displacements.

Each transducer 53 is connected, in turn, as by means of a cable 54 to a second input to the microprocessor 60.

Via a cable 55, the microprocessor 60 is connected to the solenoid valve 49 to drive it in operation as explained hereinafter.

The first step of the method according to the invention is carried out by placing a footwear blank 4 with the upper 3 preassembled to the insole 2, which is required to be glued with the sides *3a, 3b* to the insole at the arch of the foot, in an operational position of the side-lasting machine.

In the machine 5, the blank 4 is mounted, along with the former 11, on the free end of the pedestal 6.

In the second step of the inventive method, the curvature of the insole 2 is surveyed at the arch of the foot.

To this end, the adhesive spreader member 10 is activated on the machine. The rod 12 is moved away from the frame 5 and the arm 14 will move therewith.

The wheel 16 at the end 15 of the arm 14 is caused to slide on the insole 2 and travel along the section A in FIG. 1 at the arch of the foot.

Concurrently therewith, the dispensers 20 mounted on the arm 14 spread adhesive over and along the margins of the insole 2 following parallel paths to the section A.

Owing to the curvature of the insole 2, during the translatory movement imparted through the rod 12, the arm 14 is forced to oscillate about its pivot axis. Consistently therewith, an angular displacement of the gear segment is performed at the end 17 thereof, and consequently, an angular displacement will be transmitted through the pinion 18 to the transducer 19.

Depending on the angular displacement sensed, the transducer 19 will generate an electrical signal which is supplied, through the cable 61, to the microprocessor 60.

The remaining steps of the method according to this invention provide for the setting of the pressure members 9 by driving the respective motive members for setting through the curvature surveying step previously completed.

With the machine 1, that setting is controlled by the microprocessor 60 which, depending on the signal received from the transducer 19, controls the solenoid valve 49 to open or close, shutting off or not the power circuit to each fluid-operated cylinder 46 of the double-acting type.

Any displacement of the rod 45 of the respective cylinder 46 is converted into an oscillation of the base 26 as a one body with the pin 27 on the respective bracket 25.

The arm 50 is rotated rigidly with the pin 27, and rotated therewith is the pinion 52 of the transducer 53.

The transducer 53 also generates an electric signal which is sent to the microprocessor 60 over the respective cable 54.

That signal measures the angular displacement of the base 26 relatively to the bracket 25, and consequently, the setting position of the pressure members 9 relatively to the insole 2 of a piece of footwear being processed.

The microprocessor 60 forms a summing node which, being fed with the electric signals from the transducers 19 and 53, compares their values and generates a difference signal.

In the event of an other than zero difference between the values detected, the microprocessor 60 would operate the solenoid valve 49 to actuate the fluid-operated cylinders 46 and automatically adjust the setting of the two groups *9a, 9b* of pressure members.

In quite a similar manner, the angular displacement transducers 19 and 53 may be replaced with linear transducers. In this case, the ends 17 and 51 would be formed with respective slotted holes instead of the gear segments, and connected to each slotted hole is a moving element of the respective linear transducer.

Thus, the invention solves the problem set forth and affords a number of advantages.

Among these, of special relevance are rapidity and accuracy of the pressure member setting, and the ability to automatically check the exactness of said setting for each piece of footwear being processed.

Advantageously, the structure of the side-lasting machine of this invention enables automation of the operations described above without involving the complications, both in construction and operation which are typical of traditional automating systems, and among these, in particular of NC apparatus.

As the skilled person in the art will recognize, the machine of this invention could be also equipped with conventional equipment such as for preassembling and assembling the toe piece and footbed of footwear, to accomplish in one operation the assembly of the whole piece of footwear excepting the vamp, for mounting the vamp, accomplishing in one operation the mounting of the vamp and the side, or simultaneous assembing of the toe piece, footbed, side, and heel of the piece of footwear in one operation.

The term "side-lasting machine" is to means, therefore, and in the present context, any machinery potentially to incorporate the aforesaid equipment.

What is claimed is:

1. A method of gluing, to the insole of a footwear blank, the sides of a respective upper, comprising the following steps:

providing a footwear blank at an operational setting position of a side-lasting machine;

surveying the curvature of the insole in a plane perpendicular to the insole to produce a signal proportional to the curvature of said insole while simultaneously spreading an adhesive over and along the margin of the insole;

supplying said signal to a summing node fed with a signal proportional to the setting position of pressure members provided on said machine around said operational setting position;

comparing said signals at said summing node to produce a difference signal;

employing said difference signal to drive motive members for setting said pressure members about said operational setting position.

2. A side-lasting machine for gluing, to the insole of a footwear blank, the sides of a respective upper comprising, a frame, a holder for a footwear blank mounted to said frame, adapted to hold said blank in an operational setting position, a member mounted to said frame for spreading adhesive over and along the insole of said blank, a plurality of pressure members adjustably settable on said frame around said operational setting position adapted to upturn and press onto a margin of said insole coated with said adhesive a flap of the upper of said blank, characterized in that it comprises, a surveyor adapted to measure the curvature of said insole in a plane perpendicular to said insole to produce a signal proportional to the curvature of said insole, motive setting members for said pressure members, a transducer connected to the surveyor for converting the signal received therefrom into an electric signal, a microprocessor fed with said electric signal from the transducer, and shut-off members on a power circuit to said motive members driven electrically by said microprocessor.

3. A machine according to claim 2, wherein said surveyor forms a part of the adhesive spreader member comprising an arm oscillating on said frame and being movable relative to the insole of a piece of footwear being processed, said arm having one end in fretting contact with said insole and provided with adhesive dispensers and an opposite end connected to said transducer.

4. A machine according to claim 2, wherein said pressure members are mounted oscillatingly on the frame, and wherein at least one additional transducer is connected to said pressure members and to said microprocessor to compare the signal from the transducer associated with the insole curvature surveyor to the signal from said additional transducer according to the setting induced on said pressure members by said motive members.

5. A side-lasting machine for gluing to the insole of a footwear blank, the sides of a footwear upper, comprising:

a frame;

a holder mounted to said frame adapted to maintain said footwear blank in an operational setting position;

a member mounted to said frame for spreading adhesive over and along the insole of said blank and for surveying the curvature of the insole to produce a signal proportional to the curvature of the insole, including an arm pivotably mounted to said frame adapted to move relative to the curvature of the insole, said arm having one end in fretting contact with the insole and provided with adhesive dispensers and the other end connected to a transducer for converting said signal proportional to the curvature of the insole to an electrical signal;

a microprocessor for receiving the electrical signals from said transducer;

a plurality of pressure members adjustable about said operational setting position adapted to upturn and press onto an adhesive-coated margin of the insole a flap of the footwear upper;

a plurality of motive setting members for positioning said pressure members, which motive setting members are driven electrically by said microprocessor.

* * * * *